US010202716B2

(12) United States Patent
Nakajima

(10) Patent No.: US 10,202,716 B2
(45) Date of Patent: Feb. 12, 2019

(54) SEWING MACHINE

(71) Applicant: JANOME SEWING MACHINE CO., LTD., Tokyo (JP)

(72) Inventor: Makoto Nakajima, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 9 days.

(21) Appl. No.: 15/657,337

(22) Filed: Jul. 24, 2017

(65) Prior Publication Data

US 2018/0080156 A1 Mar. 22, 2018

(30) Foreign Application Priority Data

Sep. 16, 2016 (JP) ..... 2016-182015

(51) Int. Cl.
*D05B 27/02* (2006.01)
*D05B 27/24* (2006.01)
(Continued)

(52) U.S. Cl.
CPC ..... *D05B 27/02* (2013.01); *D05B 27/24* (2013.01); *D05B 29/00* (2013.01); *D05B 55/00* (2013.01); *D05B 69/24* (2013.01); *D05B 69/36* (2013.01)

(58) Field of Classification Search
CPC ..... D05B 27/02; D05B 27/06; D05B 27/08; D05B 27/24; D05B 29/00; D05B 55/00; D05B 69/24; D05B 69/00; D05B 69/36; D05C 15/26; D05C 7/04; G04F 7/66; G04F 19/00
See application file for complete search history.

(56) References Cited

U.S. PATENT DOCUMENTS 2,145,822 A * 1/1939 Weis ..... D05B 69/30 112/200
2,893,337 A * 7/1959 Irmscher ..... D05B 27/02 112/199
(Continued)

FOREIGN PATENT DOCUMENTS

JP 61131788 A * 6/1986
JP 04079986 A * 3/1992
(Continued)

OTHER PUBLICATIONS

Office Action dated Oct. 18, 2018, issued in counterpart Taiwanese Application No. 106127455. (3 pages).

*Primary Examiner* — Ismael Izaguirre
(74) *Attorney, Agent, or Firm* — Westerman, Hattori, Daniels & Adrian, LLP

(57) ABSTRACT

A sewing machine capable of replacing a feed dog in accordance with a type of sewing, the sewing machine including a feed bar performing a horizontal motion and a vertical motion by interlocking with a feeding mechanism, a feed dog detachably mounted on the feed bar, and a control unit that identifies the feed dog mounted on the feed bar. In the sewing machine, the feed dog includes an identification member that corresponds to a type of the feed dog, the feed bar includes a sensor that detects the identification member and outputs an identification signal, and the control unit includes a feed dog identifying means that, based on the identification signal from the sensor member, identifies the type of the feed dog mounted on the feed bar.

27 Claims, 11 Drawing Sheets

(51) Int. Cl.

| | |
|---|---|
| ***D05B 29/00*** | (2006.01) |
| ***D05B 55/00*** | (2006.01) |
| ***D05B 69/24*** | (2006.01) |
| ***D05B 69/36*** | (2006.01) |

(56) References Cited

U.S. PATENT DOCUMENTS

| | | | | | |
|---|---|---|---|---|---|
| 3,320,912 | A | * | 5/1967 | Ketterer | D05B 27/02 112/168 |
| 4,120,254 | A | * | 10/1978 | Herr | D05B 27/22 112/220 |
| 4,289,084 | A | * | 9/1981 | Takenoya | D05B 19/02 112/235 |
| 2016/0194797 | A1 | | 7/2016 | Fukuba et al. | |

FOREIGN PATENT DOCUMENTS

| | | | | |
|---|---|---|---|---|
| JP | 04208192 | A | * | 7/1992 |
| JP | 2004-24764 | A | | 1/2004 |
| JP | 2016-123772 | A | | 7/2016 |
| TW | 201144510 | A1 | | 12/2011 |

* cited by examiner

SEWING MACHINE

BACKGROUND OF THE INVENTION

1. Field of the Invention

The present disclosure relates to a sewing machine capable of replacing a needle plate and a feed dog in accordance with a type of sewing and, in particular, relates to a sewing machine in which an operator is capable of mounting and dismounting the feed dog with a simple operation and in which the mounted or dismounted state of the feed dog and the type of the feed dog that has been mounted can be automatically identified.

2. Description of the Related Art

A feeding mechanism of a sewing machine is known in which a piece of fabric that is pinched between a hold metal and a needle plate is fed by protruding and retracting (vertically moving) a feed dog through a long hole for the feed dog formed in the needle plate and by moving (horizontally moving) the feed dog in a front-rear direction. As illustrated in FIG. 11, conventionally, a feed dog F is detachably fixed to a feeding mechanism (a feed bar 63) with fastening members 62, such as screws. In order to perform stitching in a more efficient manner, the needle plate and the feed dog need to be replaced in accordance with the type of the sewing, such as straight stitch and zigzag stitch, so as to suit the type of sewing.

However, since the feed dog is fixed to the feed bar at a portion below the needle plate, the needle plate needs to be dismounted each time the feed dog is replaced. Since the feed dog protrudes and retracts above the long hole for the feed dog formed in the needle plate, the gap between the long hole for the feed dog in the needle plate and the feed dog is designed to be small as possible to prevent the fabric from being dragged into the long hole for the feed dog in the needle plate. Accordingly, unless the feed dog is attached to the feed bar in an accurate manner, the feed dog may come into contact with the needle plate while the feed dog is in operation.

When the feed dog is replaced, the needle plate is first dismounted from the sewing machine, and after the replaced feed dog is temporally fixed to the feed bar, the needle plate is attached to the sewing machine once more. Subsequently, the fixing position of the feed dog is set by checking both the gap between the feed dog and the long hole for the feed dog in the needle plate, and the needle location in the needle hole, and the needle plate is dismounted without moving the feed dog. Finally, the fastening members of the feed dog are finally tightened so that the feed dog is fixed to the feed bar, the needle plate is attached once more, and the positional relationship between the needle plate and the feed dog is checked once more. If the position of the feed dog during final tightening is displaced, the needle plate needs to be dismounted once more and the adjustment of the feed dog needs to be redone. As described above, the operation of replacing the feed dog is very complex and needs much time and effort; accordingly, there is an issue in that the operator cannot easily carry out the operation of replacing the feed dog.

In order to overcome the above issues, Japanese Unexamined Patent Application Publication No. 2016-123772 (U.S. Patent Application Publication No. 2016/0194797, Description) discloses a conventionally known sewing machine including a feed bar applied with a motion in a feeding direction of the fabric, and a feed dog that feeds the fabric on the needle plate. The feed bar includes a mount portion on which the feed dog is mounted so as to be capable of being separated therefrom, and the feed dog includes a cam portion for mounting on the mount portion. The cam portion includes a flat first cam surface that comes in surface contact with a first receiving surface of the mount portion, a second cam surface that comes in line contact with a second receiving surface, and a third cam surface that is pressed by a pressing member. The surface contact between the first cam surface and the first receiving surface, and the line contact between the second cam surface and the second receiving surface are maintained by the pressing member, the feed dog is held by the feed bar in a suitable manner. The feed dog can be separated by pulling the feed dog against the pressing member in a direction opposite to the insertion direction, and replacement of the feed dog can be performed easily.

SUMMARY OF THE INVENTION

However, in the sewing machine described in Japanese Unexamined Patent Application Publication No. 2016-123772 (U.S. Patent Application Publication No. 2016/0194797, Description) described above, since the operator is not capable of easily checking whether the feed dog that has been replaced is a feed dog that matches the type of the sewing and whether the replaced feed dog is reliably mounted on the feed bar, there is an issue from the viewpoint of using the sewing machine safely.

An issue of the present disclosure is overcoming the above problem and an object of the present disclosure is to provide a sewing machine in which the operator can mount and dismount the feed dog with a simple operation and in which determination of whether the feed dog matches the selected type of the sewing and whether the feed dog is reliably mounted on the feed bar can be performed automatically by automatically identifying the feed dog that has been mounted by the replacement operation.

In order to overcome the issue described above, a sewing machine according to an aspect of the present disclosure employs a configuration in which the sewing machine is capable of replacing a feed dog in accordance with a type of sewing, the sewing machine including a feed bar performing a horizontal motion and a vertical motion by interlocking with a feeding mechanism, a feed dog detachably mounted on the feed bar, and a control unit that identifies the feed dog mounted on the feed bar. In the sewing machine, the feed dog includes an identification member that corresponds to a type of the feed dog, the feed bar includes a sensor member that detects the identification member and outputs an identification signal, and the control unit includes a feed dog identifying means that, based on the identification signal from the sensor member, identifies the type of the feed dog mounted on the feed bar.

An exemplary embodiment of the identification member and the sensor member according to the present disclosure employs a configuration in which the identification member includes a pressing portion formed on the feed dog, the sensor member includes a pressure sensor that detects pressing force of the pressing portion and that outputs a pressure-sensitive signal, and the control unit includes a feed dog mounted or dismounted determination means that, based on whether there is the pressure-sensitive signal from the pressure sensor, determines whether the feed dog is mounted or dismounted. Furthermore, a configuration is employed in which the pressing portion includes a projection that projects from an underside of the feed dog, and the feed bar includes, at a position opposing the projection, an attachment hole in which the pressure sensor is embedded.

A specific exemplary embodiment of the identification member and the sensor member according to the present disclosure employs a configuration in which the identification member includes a projection row in which at least one projection is arranged, and the sensor member includes a pressure sensor group that opposes the projection row, the pressure sensor group detecting whether there is the projection and outputting an identification signal corresponding to the projection row. Furthermore, a configuration is employed in which the control unit includes a feed dog mounted or dismounted determination means that, based on the identification signal from the pressure sensor group, determines whether the feed dog is mounted or dismounted. Further included is a sewing machine motor controller that controls the sewing machine motor and that starts or stops the sewing machine, in which the control unit includes a sewing machine stop commanding means that commands stoppage of the sewing machine to the sewing machine motor controller in a case in which the feed dog mounted or dismounted determination means determines that the feed dog is not mounted.

Moreover, a specific exemplary embodiment of the feed bar and a feed dog according to the present disclosure employs a configuration in which the feed bar incudes a feed bar base portion that is interlocked with the feeding mechanism, and a feed dog mount portion that is attached so as to be capable of being positioned with respect to the feed bar base portion, the sensor member being provided in the feed dog mount portion, and the feed dog includes an attaching portion that is detachably mounted on the feed dog mount portion, the identification member being provided in the attaching portion. Furthermore, a configuration is employed in which the feed dog mount portion includes a lifting spring that biases the attaching portion upwards, and a release lever countering biasing force of the lifting spring that presses and fixes the attaching portion to the feed dog mount portion. Moreover, an exemplary embodiment of the control unit according to the present disclosure employs a configuration in which the control unit includes a feed dog match determining means that determines whether the type of the feed dog identified by the feed dog identifying member matches the type of the sewing that has been selected. Furthermore, a configuration is employed in which the control unit includes an error indicating means that informs an operator in a case in which the feed dog match determining means determines that the type of the feed dog mounted on the feed bar does not match the type of the sewing that has been selected.

The sewing machine according to the present disclosure includes the feed bar performing the horizontal motion and the vertical motion by interlocking with the feeding mechanism, the feed dog detachably mounted on the feed bar, and the control unit that identifies the feed dog mounted on the feed bar, and in the sewing machine, the feed dog includes the identification member that corresponds to the type of the feed dog, the feed bar includes the sensor that detects the identification member and outputs the identification signal, and the control unit includes the feed dog identifying means that, based on the identification signal from the sensor member, identifies the type of the feed dog mounted on the feed bar; accordingly, an operator is capable of replacing the feed dog in a detachable manner with a simple operation and the feed dog that has been mounted by the replacement operation can be automatically identified. Moreover, since the type of the feed dog that has been mounted by the replacement operation can be identified, determination of whether the type of the identified feed dog matches the type of the selected sewing is automatically performed, and an error can be notified to the operator when the types are determined to not match each other.

Furthermore, in the sewing machine according to the present disclosure, the identification member includes the pressing portion formed on the feed dog, the sensor member includes the pressure sensor that detects the pressing force of the pressing portion and that outputs the pressure-sensitive signal, and the control unit includes the feed dog mounted or dismounted determination means that, based on whether there is the pressure-sensitive signal from the pressure sensor, determines whether the feed dog is mounted or dismounted; accordingly, not only determination of whether the feed dog is reliably mounted on the feed bar can be performed but also, in a case in which the feed dog is, if by any chance, not mounted on the feed bar, a command to stop the sewing machine is issued to the sewing machine motor controller so that the sewing machine is not actuated, therefore, the sewing machine can be used safely.

BRIEF DESCRIPTION OF THE DRAWINGS

FIG. 3A is a top view and FIG. 3B is a cross-sectional arrow view of FIG. 3A.

FIG. 7A illustrates a state before mounting and FIG. 7B illustrates a state at the time when mounting is started.

DESCRIPTION OF THE PREFERRED EMBODIMENTS

A sewing machine of an exemplary embodiment of the present disclosure will be described next with reference to the drawings.

Exemplary Embodiment

Figure 1:
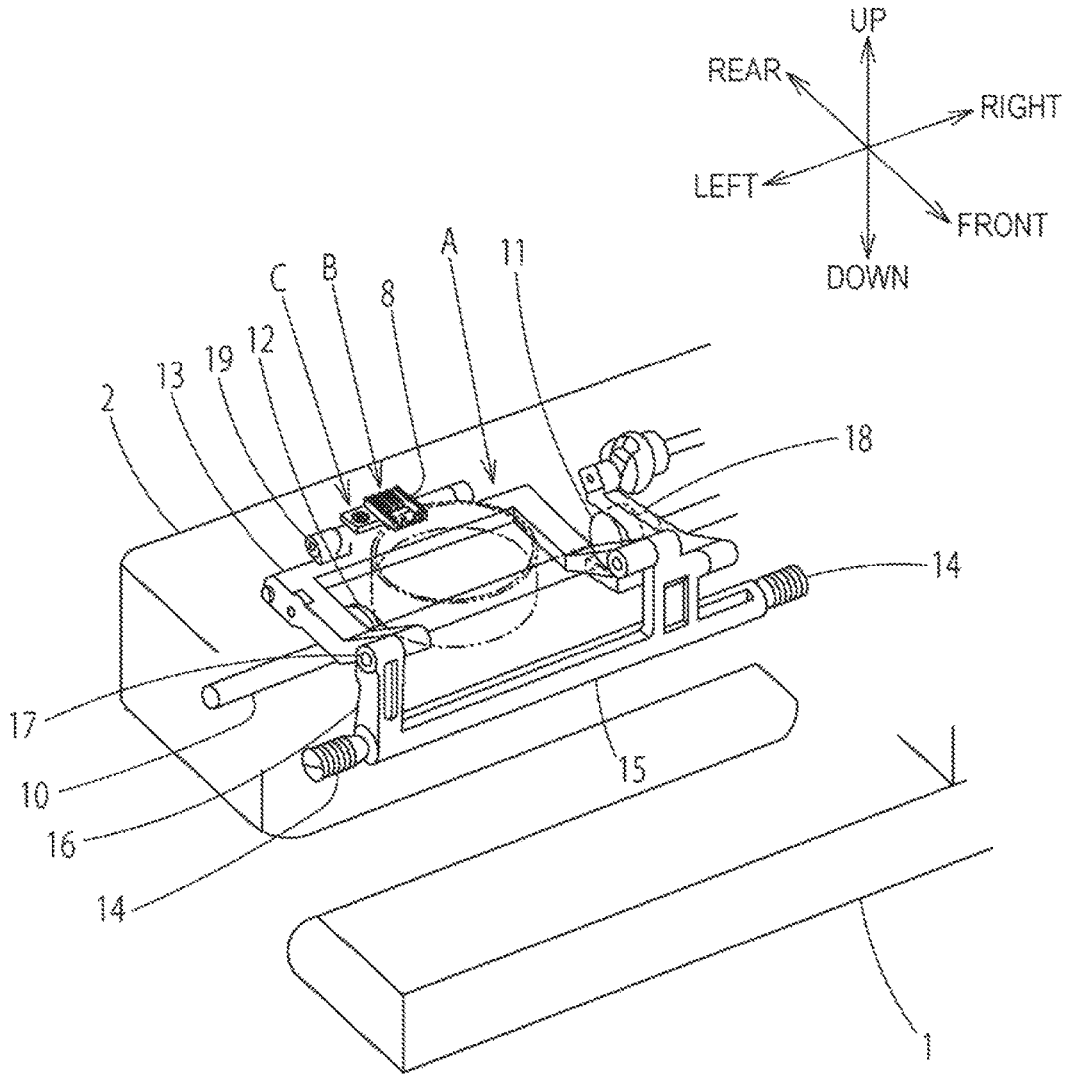
FIG. 1 is a perspective view illustrating a feeding mechanism in a sewing machine according to an exemplary embodiment of the present disclosure.
Figure 2:
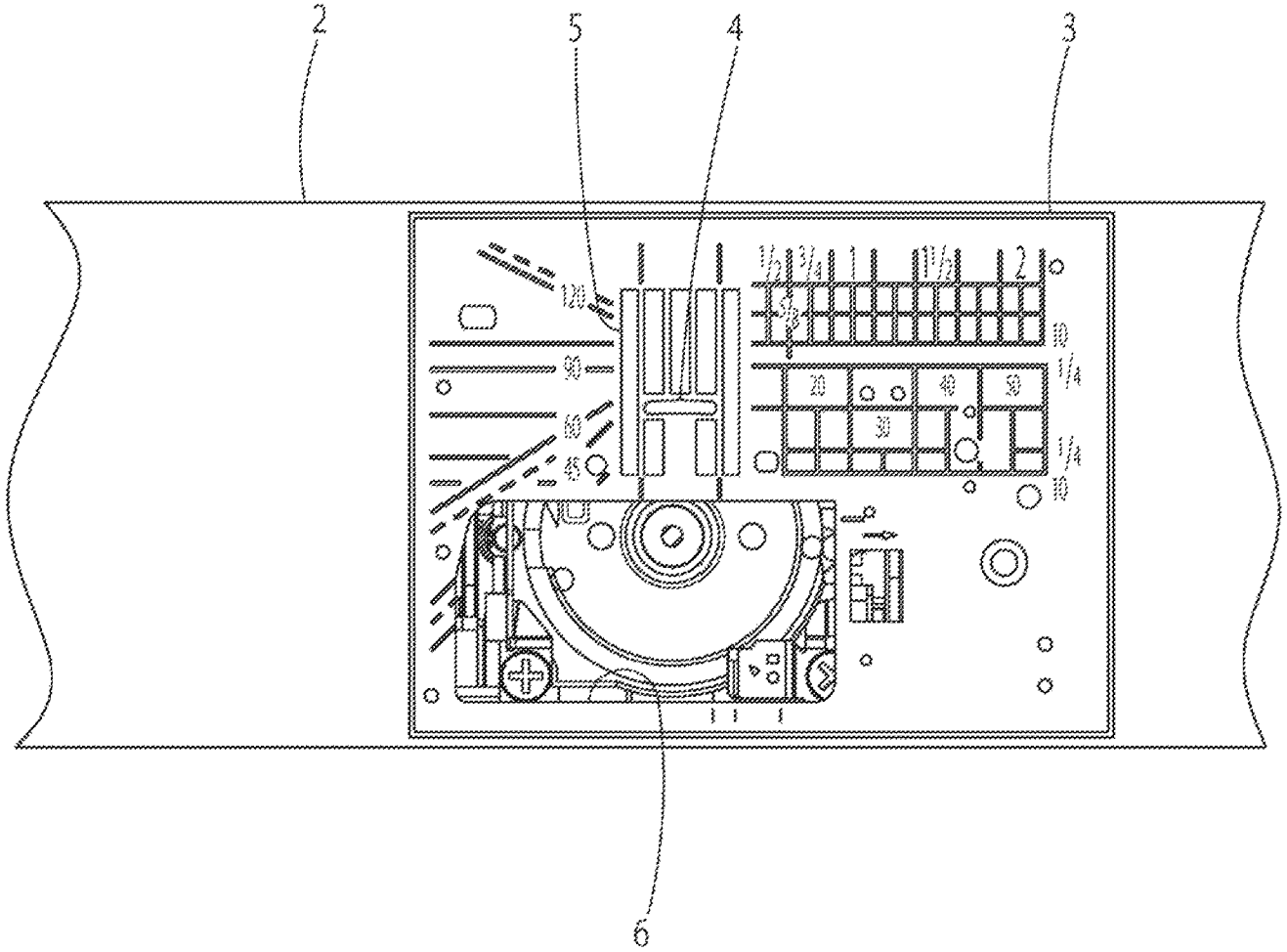
FIG. 2 is a plan view illustrating a portion of a free arm portion on which a needle plate has been mounted in a sewing machine according to an exemplary embodiment of the present disclosure.

In the following description, the longitudinal direction of FIG. 1, a perspective view, is referred to as "up-down", the direction from the upper right to the lower left is referred to as "right-left", and the direction from the lower right to the upper left is referred to as "front-rear". In FIGS. 1 and 2, reference numeral 1 is a bed portion, reference numeral 2 is a free arm portion that extends from the bed portion 1 in a cylindrical manner, reference numeral 3 is a needle plate mounted in an upper surface of the free arm portion 2. As illustrated in FIG. 2, a transversely elongated needle hole 4 in which zigzag stitch can be performed, a plurality of longitudinally elongated long holes 5 for a feed dog, and an opening 6 for exchanging bobbin thread bobbins are formed in the needle plate 3.

A feeding mechanism A is accommodated inside the free arm portion 2, and a piece of fabric is fed by protrusion and retraction of a plurality of tooth rows 8 of a feed dog B from the long holes 5 for the feed dog of the needle plate 3. As illustrated in FIG. 1, the feeding mechanism A transmits a fabric feeding motion to the feed dog B. The fabric feeding motion is a combination of a horizontal feed motion in the front-rear direction that is generated by a horizontal feed cam 11 secured to a lower shaft 10 rotatably supported inside the free arm portion 2, and a vertical feed motion in the up-down direction that is generated by a vertical feed cam 12 secured to the lower shaft 10.

The feed dog B is mounted on a feed bar C attached to a rear end portion of a feed rock shaft crank 13. A front end portion of the feed rock shaft crank 13 is rotatably supported by pivot pins 17 fixed to the arm portions 16 formed in an integrated manner with a feed rock shaft 15 that is supported about screw centers 14 fixed to the free arm portion 2 in a swingable manner. The feed rock shaft 15 is swung by a feed fork 18 that is fitted to the horizontal feed cam 11 secured to the lower shaft 10. The feed rock shaft crank 13 converts a swinging motion of the feed rock shaft 15 into a front-rear motion and transmits the motion to the feed dog B.

The feed bar C is attached to the rear end portion of the feed rock shaft crank 13 with a pivot shaft 19 in a swingable manner. The feed bar C following the vertical feed cam 12 secured to the lower shaft 10 is swung about the pivot shaft 19, and the feed dog B attached to the feed bar C is protruded and retracted through the long holes 5 for the feed dog of the needle plate 3.

Figure 3A:
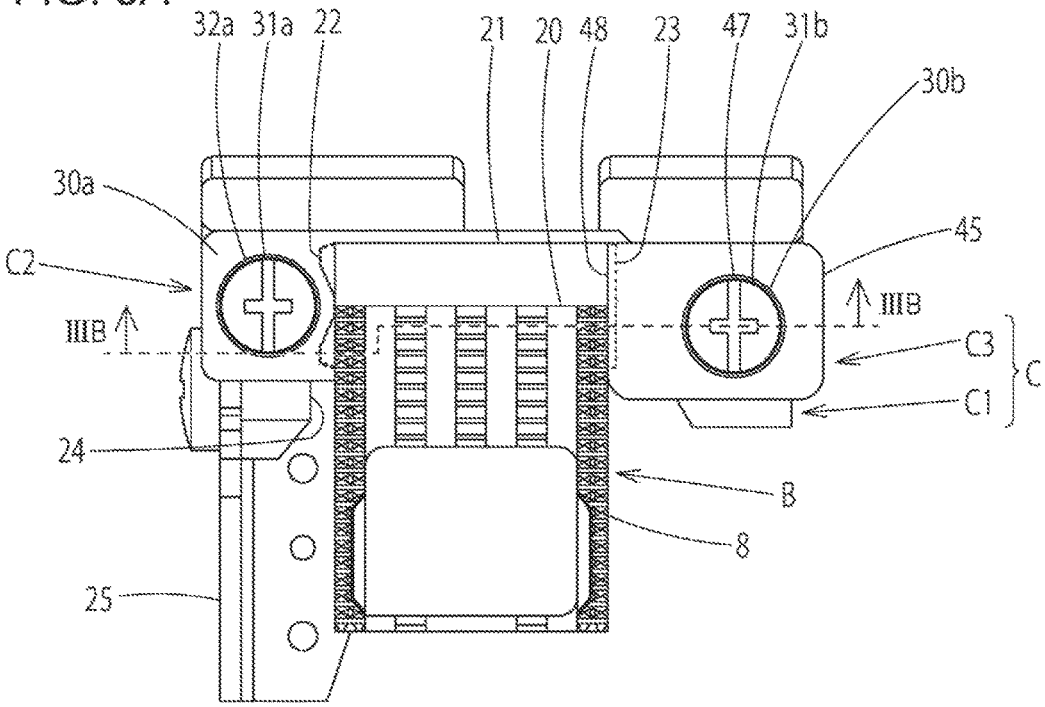
FIGS. 3A and 3B are diagrams illustrating a state in which a feed dog is mounted on a feed bar.
Figure 3B:
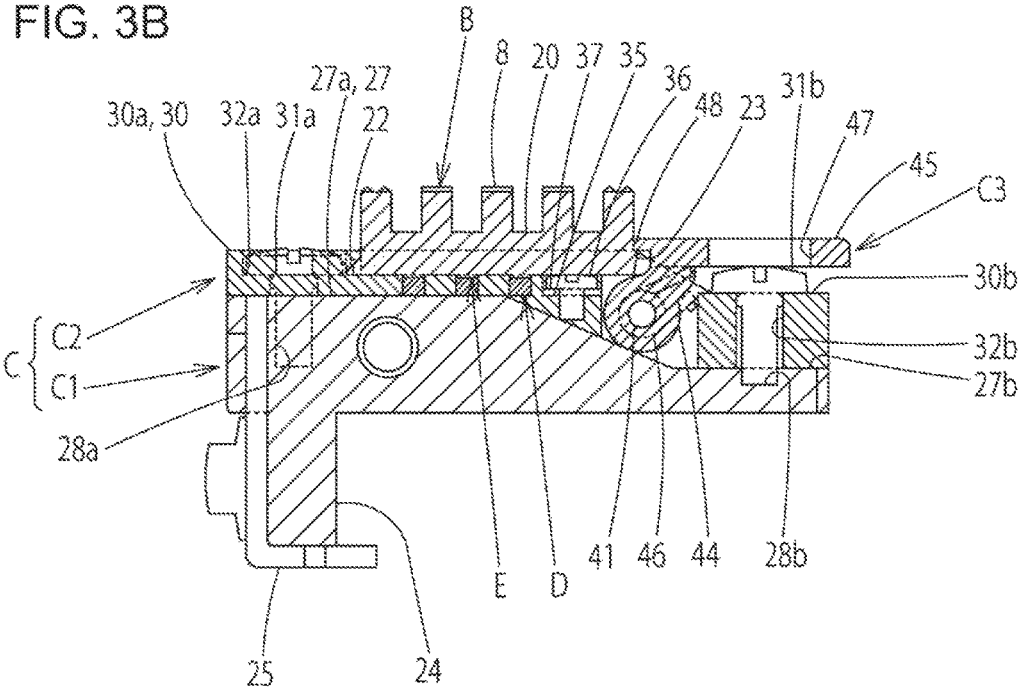
Figure 4:
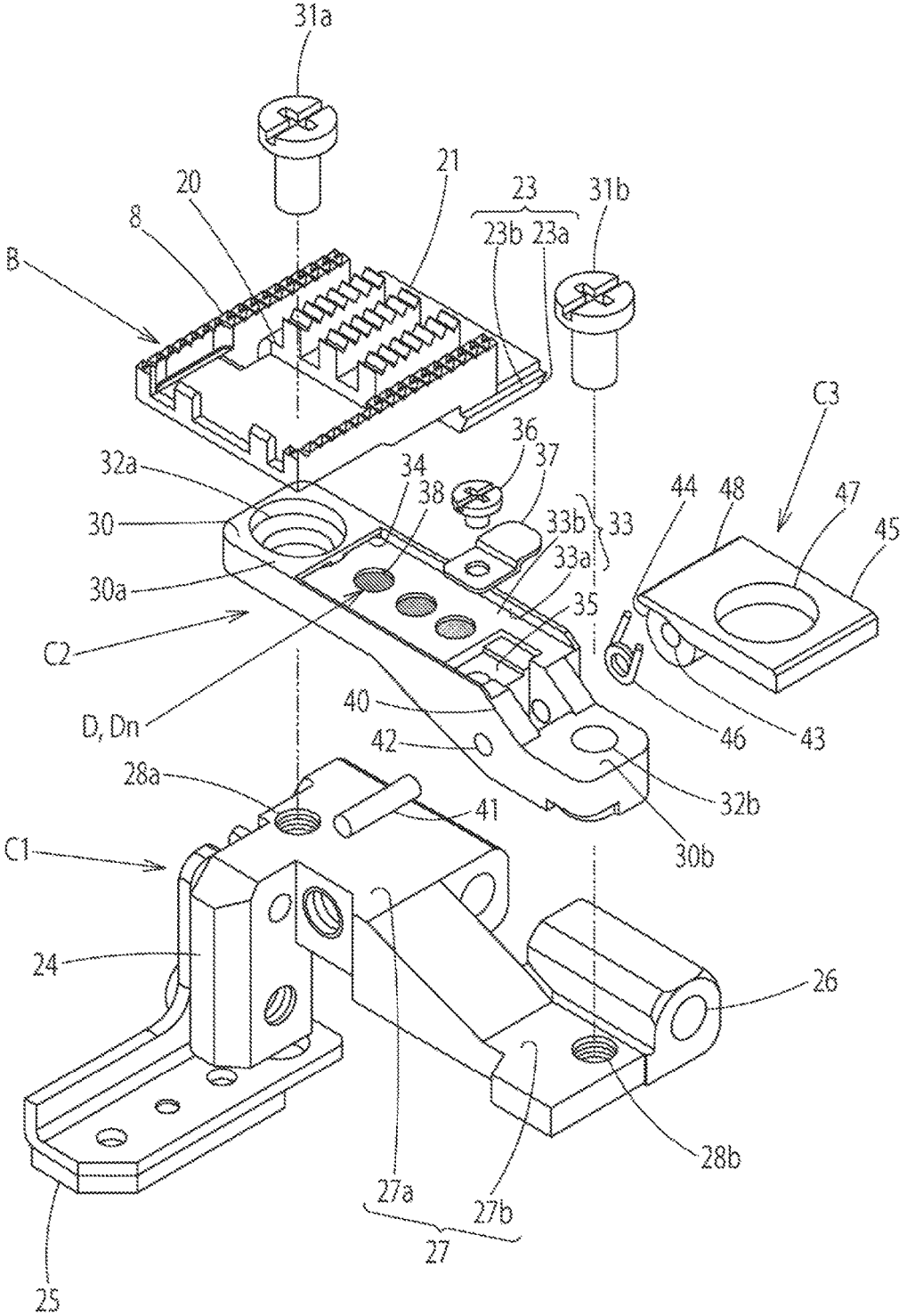
FIG. 4 is a perspective view illustrating a state in which a feed dog and a feed bar in a sewing machine according to an exemplary embodiment of the present disclosure are decomposed into components.

As illustrated in FIGS. 3A, 3B, and 4, the feed dog B includes a feed dog portion 20 in which the plurality of tooth rows 8 formed so as to act on the fabric by abutting against the fabric are each arranged at predetermined positions on the upper surface of the feed dog portion 20, and a rectangular block-shaped attaching portion 21 provided on the underside and on the rear side of the feed dog portion 20 in a continuous manner. A plurality of types of feed dog B are readily available. The tooth rows 8 of each feed dog portion 20 are changed so as to have a tooth height and an arrangement pattern matching the sewing type.

Figure 5:
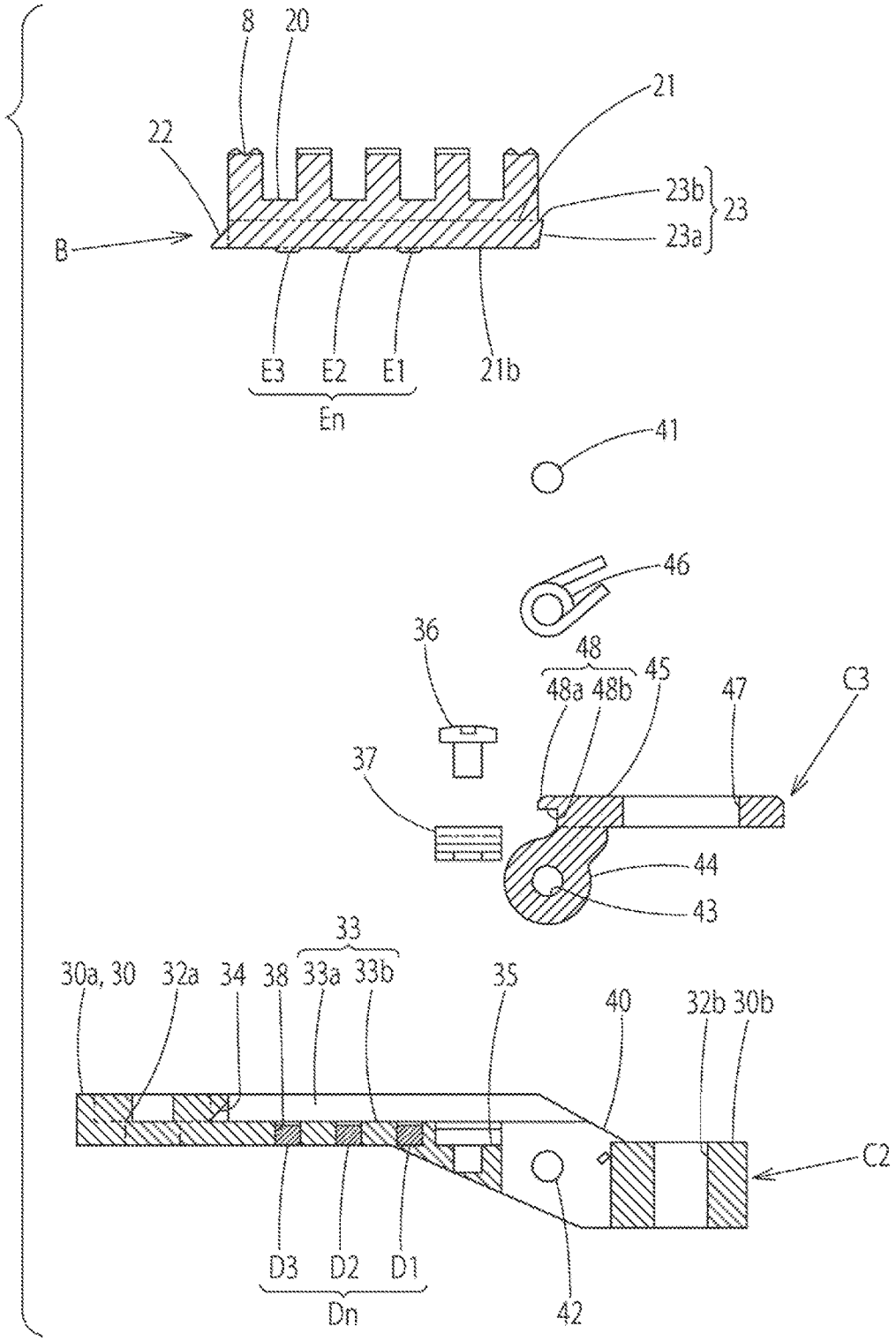
FIG. 5 is a cross-sectional view illustrating a state in which a feed dog, a feed dog mount portion, and a release lever in a sewing machine according to an exemplary embodiment of the present disclosure are decomposed into components.
Figure 6:
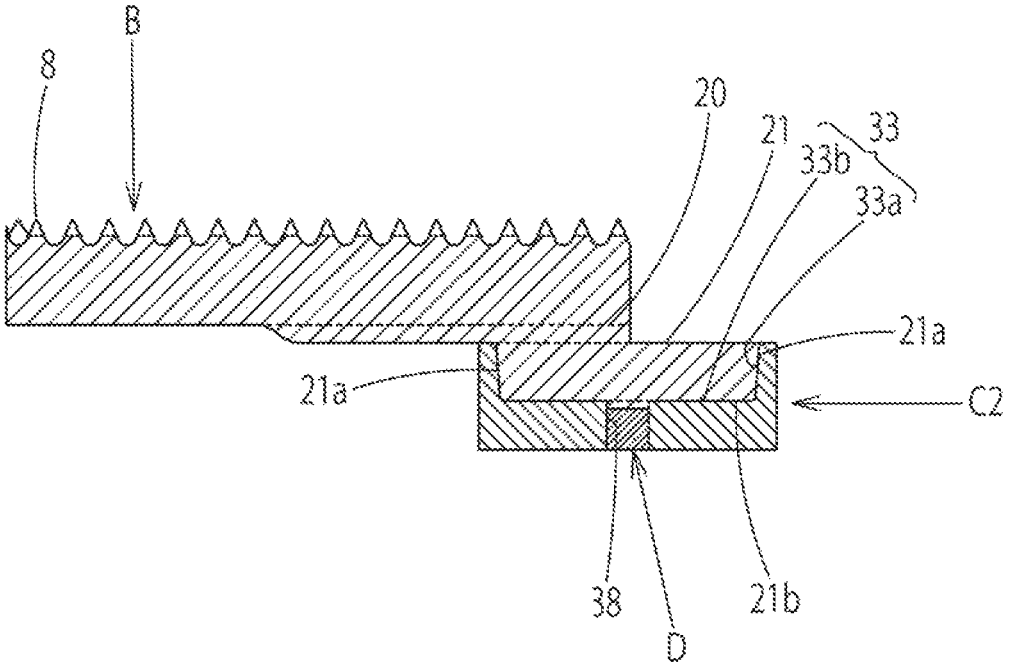
FIG. 6 is a cross-sectional view of a feed dog mount portion on which a feed dog is mounted in a sewing machine according to an exemplary embodiment of the present disclosure.

As illustrated in FIG. 6, front and rear lateral sides 21*a* of the attaching portion 21 are each formed in a tapered shape, and as illustrated in FIG. 3A, a pair of front and rear insertion pieces 22 are provided on the left end side and a locking protruding piece 23 is provided on the right end side. As illustrated in FIGS. 4 and 5, the locking protruding piece 23 includes an oblique underside 23*a* that extends upwards from a right end of an underside 21*b* of the attaching portion 21 towards the outside, and locking upper surface 23*b* that extends horizontally from a right upper end of the attaching portion 21 towards an upper end of the oblique underside 23*a*.

A projection row En is provided on the underside 21*b* of the attaching portion 21. The projection row En is an identification member in which one to three projections E functioning as pressing portions are aligned so as to oppose a sensor group Dn of a feed dog mount portion C2 described later. In other words, the arrangement patterns of the projections E are changed in the projection row En so that the type of the feed dog B that has been mounted is identified.

As illustrated in FIG. 4, the feed bar C includes a feed bar base portion C1 that is attached in a swingable manner about the pivot shaft 19 (see FIG. 1) fixed to the rear end portion of the feed rock shaft crank 13, the feed dog mount portion C2 that is attached so as to be capable of being positioned on an upper surface of the feed bar base portion C1, and a release lever C3 that detachably attaches the attaching portion 21 of the feed dog B to the feed dog mount portion C2.

The feed bar base portion C1 includes a following portion 25 at a lower end of a leg portion 24 hanging downwards from the left side. The following portion 25 abuts against the vertical feed cam 12 (see FIG. 1). Pivot shaft holes 26 into which the pivot shaft 19 is inserted are formed on the rear side of the feed bar base portion C1. The feed bar base portion C1 includes an upper surface 27 formed with an upper step surface 27*a* formed at a high position on the left side of the feed bar base portion C1, and a lower step surface 27*b* formed at a position lower than that of the upper step surface 27*a* and on the right side of the feed bar base portion C1. Fixing screw holes 28*a* and 28*b* that are screwed together with fixing screws 31*a* and 31*b*, respectively, described later are formed in predetermined positions in the upper step surface 27*a* and the lower step surface 27*b*, respectively.

Steps are formed on the bottom surface of the feed dog mount portion C2 so as to correspond to the upper step surface 27*a* and the lower step surface 27*b* formed in the feed bar base portion C1. The feed dog mount portion C2 includes an upper surface 30 formed with an upper step surface 30*a* formed at a high position on the left side of the feed dog mount portion C2, and a lower step surface 30*b* formed at a position lower than that of the upper step surface 30*a* and on the right side of the feed dog mount portion C2. Fixing holes 32*a* and 32*b* that are screwed together with fixing screws 31*a* and 31*b*, respectively, are formed in predetermined positions in the upper step surface 30*a* and the lower step surface 30*b*, respectively.

In order to fit the attaching portion 21 of the feed dog B, the feed dog mount portion C2 is provided with a fitting recess 33 that extends to the right side and that is adjacent to the fixing hole 32*a* formed in the upper step surface 30*a*. As illustrated in FIGS. 5 and 6, in the fitting recess 33, the front and rear lateral sides 33*a* have shapes that are tapered with respect to a bottom surface 33*b*, and a pair of insertion receiving portions 34 corresponding to the pair of insertion pieces 22 of the attaching portion 21 are formed on the left side surface. Furthermore, the right side of the fitting recess 33 is open.

A spring recess 35 is formed in the right side of the bottom surface 33*b*. A lifting spring 37 that biases the attaching portion 21 of the feed dog B upwards is fixed to the spring recess 35 with a small fixing screw 36. Three attachment holes 38 are each formed in the bottom surface 33*b* at a position avoiding the spring recess 35 and in the up-down direction. Three pressure sensors D1, D2, and D3 that detect pressing force of the one to three projections E, which are provided on the underside 21*b* of the attaching portion 21 of the feed dog B and that function as pressing portions, are embedded in the attachment holes 38.

A pair of front rear bearing walls 40 are formed between the upper step surface 30*a* and the lower step surface 30*b* of the feed dog mount portion C2, and bearing holes 42 in which a rotating shaft 41 is inserted and that fix the rotating shaft 41 are provided in the bearing walls 40.

The release lever C3 includes a shaft portion 44 in which a shaft hole 43 into which the rotating shaft 41 is inserted is formed, and a lever plate 45 provided so as to extend rightwards from an upper portion of the shaft portion 44. The lever plate 45 is biased so as to be horizontal with respect to the upper step surface 30*a* of the feed dog mount portion C2 with repulsive force of a lever spring 46 wound around the rotating shaft 41 between the shaft portion 44 and the bearing walls 40.

A through hole 47 through which the fixing screw 31*b* penetrates is drilled in the lever plate 45 in the up-down direction. A locking portion 48 that abuts against the locking protruding piece 23 of the attaching portion 21 of the feed dog B is formed on a left end portion of the lever plate 45. As illustrated in FIG. 5, an oblique upper surface 48*a* that inclines from an upper end towards the left side, and a lock underside 48*b* that extends horizontally from an edge of the oblique upper surface 48*a* are formed in the locking portion 48.

Figure 9:
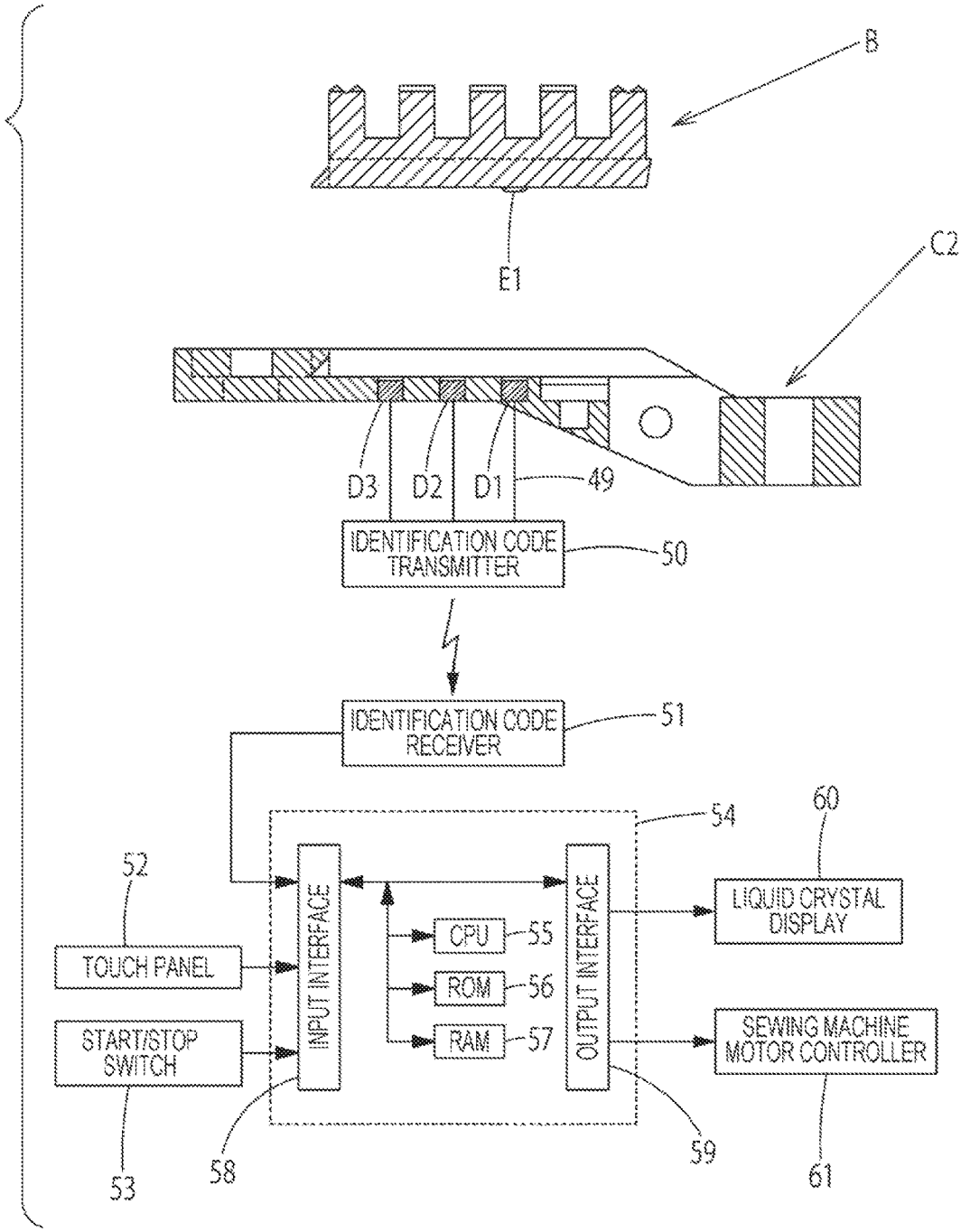
FIG. 9 is a block diagram illustrating a control system of a sewing machine according to an exemplary embodiment of the present disclosure.

As illustrated in the block diagram in FIG. 9, the sewing machine of the present exemplary embodiment includes a control system. The three pressure sensors D1, D2, and D3 that oppose the projection row En (only the projection E1 in FIG. 9) provided in the feed dog B are provided in the feed dog mount portion C2. A signal line 49 of each of the pressure sensors D1, D2, and D3 is connected to an identification code transmitter 50. The identification code transmitter 50 wirelessly transmits, in the form of radio waves or the like, identification codes serving as identification signals from the pressure sensors D1, D2, and D3 to an identification code receiver 51. Note that in the present exemplary embodiment, the identification signals from the pressure sensors D1, D2, and D3 are transmitted to the identification code transmitter 50 through the signal lines 49; however, the identification signals from the pressure sensors D1, D2, and D3 may be directly transmitted to an input interface 58 described later through the signal lines 49.

A control unit 54 that identifies the feed dog B mounted on the feed bar C is provided in the sewing machine body. The control unit 54 includes a microcomputer including a CPU 55, a ROM 56, and a RAM 57, the input interface 58, and an output interface 59. The identification code receiver 51, a touch panel 52, and a start/stop switch 53 are connected to the input interface 58. A liquid crystal display 60 and a sewing machine motor controller 61 are connected to the output interface 59.

The liquid crystal display 60 provided in the sewing machine body includes the transparent touch panel 52 stacked on the front side thereof. Various work menus, function menus, and messages needed for the sewing work are displayed on the liquid crystal display 60 on which the transparent touch panel 52 is stacked, and by performing a touch operation on a "type of the sewing selection" display in the work menu, as described below, determination is made whether the mounted feed dog B matches the selected type of sewing, and the determination result is displayed on the liquid crystal display 60. Furthermore, the sewing machine motor controller 61 controls a sewing machine motor (not shown) upon operation of the start/stop switch 53, and starts or stops the sewing machine.

Use modes and effects of the present embodiment will be described. As illustrated in FIG. 4, in the feed bar C, in order to attach the release lever C3 to the feed dog mount portion C2, the rotating shaft 41 is inserted through the bearing hole 42 of the bearing wall 40 of the feed dog mount portion C2 on the front side and is sequentially inserted through the lever spring 46 and the shaft hole 43 of the shaft portion 44 formed in the release lever C3, and is, lastly, inserted through the bearing hole 42 of the bearing walls 40 on the rear side. The release lever C3 being biased with the lever spring 46 is mounted on the feed dog mount portion C2 so as to be rotatable with respect to the feed dog mount portion C2 about the rotating shaft 41, and so as to be horizontal to the upper step surface 30*a* of the feed dog mount portion C2.

In order to attach the feed dog mount portion C2 to the feed bar base portion C1, the feed dog mount portion C2 is placed on the upper surface 27 of the feed bar base portion C1 and, then, the fixing screw 31*a* is inserted into the fixing hole 32*a* of the feed dog mount portion C2 from above and is screwed to the fixing screw hole 28*a* of the feed bar base portion C1. In a similar manner, the fixing screw 31*b* is passed through the through hole 47 of the release lever C3, is inserted into the fixing hole 32*b* of the feed dog mount portion C2, and is, further, screwed into the fixing screw hole 28*b* of the feed bar base portion C1. As described above, the feed dog mount portion C2 can be positioned and fixed to the feed bar base portion C1 by being screwed with the fixing screws 31*a* and 31*b*. The feed bar C assembled in the above described manner is set to the feeding mechanism A.

Figure 7A:
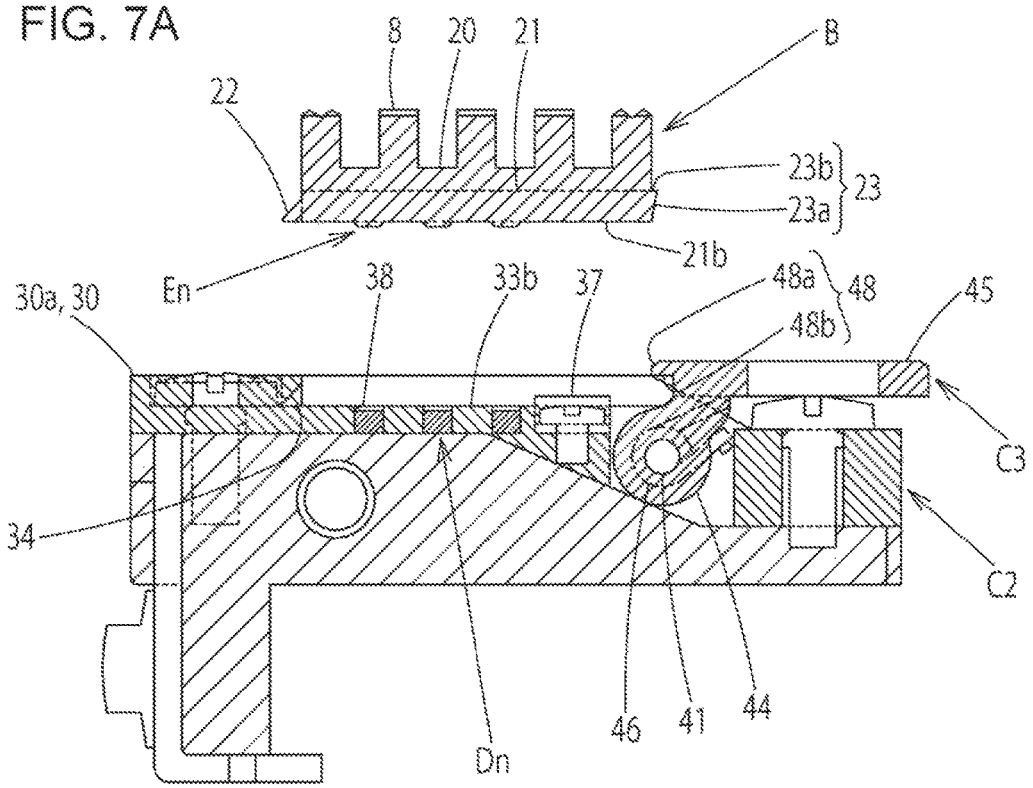
FIGS. 7A and 7B are cross-sectional views illustrating a manner in which a feed dog is mounted on and dismounted from a feed bar in a sewing machine according to an exemplary embodiment of the present disclosure.
Figure 7B:
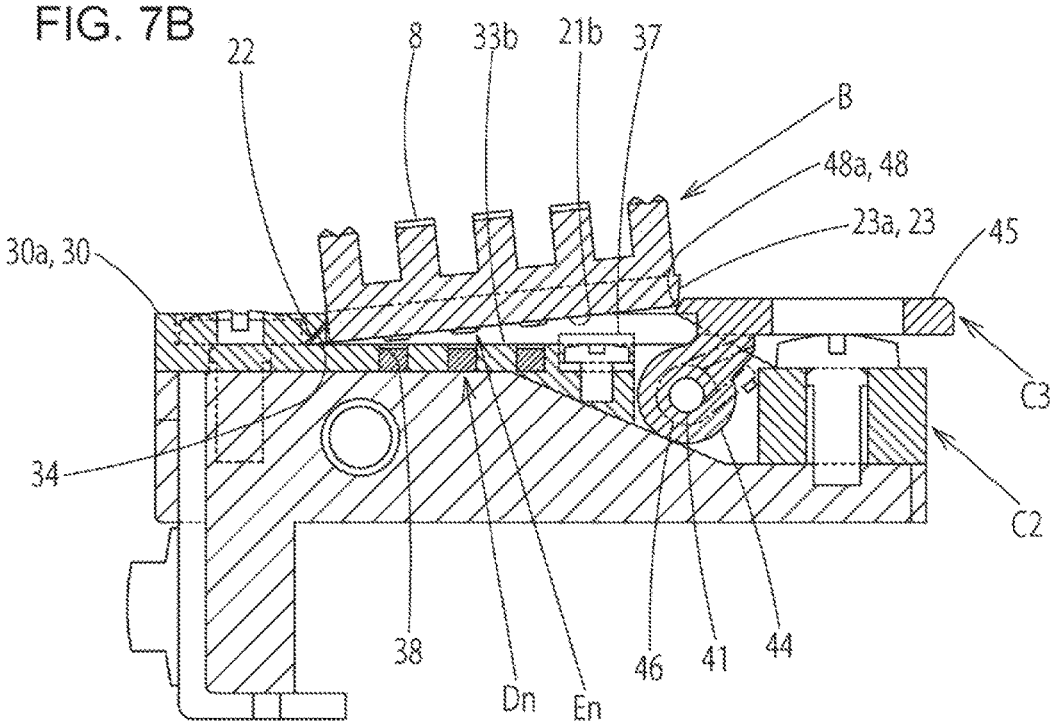

As illustrated in FIGS. 7A and 7B, in order to mount the feed dog B on the feed bar C, the pair of insertion pieces 22 formed on the left end side of the attaching portion 21 of the feed dog B are inserted into the insertion receiving portions 34 formed in the left side surface of the fitting recess 33 of the feed dog mount portion C2, and the right side of the feed dog B is pushed into the fitting recess 33 about the insertion receiving portions 34 serving as a fulcrum. In the course of pushing in the right side of the feed dog B, when the underside 21*b* of the attaching portion 21 presses down the lifting spring 37 mounted in the fitting recess 33, the oblique underside 23*a* of the locking protruding piece 23 of the attaching portion 21 abuts against the oblique upper surface 48*a* of the locking portion 48 of the release lever C3 mounted on the feed dog mount portion C2. With the abutment of the oblique underside 23*a* of the locking protruding piece 23, the release lever C3 is pushed outwardly and the release lever C3 pivotally supported by the rotating shaft 41 rotates slight to the right.

Subsequently, at the same time as when the abutment between the oblique underside 23*a* of the locking protruding piece 23 of the attaching portion 21 and the oblique upper surface 48*a* of the locking portion 48 of the release lever C3 is released, as illustrated in FIG. 3B, the release lever C3 is returned to the horizontal position with respect to the feed dog mount portion C2 with the biasing force of the lever spring 46, and, in this case, the locking upper surface 23*b* of the locking protruding piece 23 and the lock underside 48*b* of the locking portion 48 abut against each other such that the attaching portion 21 of the feed dog B is locked. The feed dog B is guided into the feed dog mount portion C2 so as to be in a predetermined positional relationship with the feed dog mount portion C2 with the tapered shapes of the front and rear lateral sides 21*a* of the attaching portion 21 and the tapered shapes of the front and rear lateral sides 33*a* of the fitting recess 33.

As described above, the feed dog B is fixed and mounted on the feed dog mount portion C2 by fitting the insertion pieces 22 on the left side of the attaching portion 21 and the insertion receiving portions 34 on the left side of the fitting recess 33 to each other, by fitting the locking protruding piece 23 on the right side of the attaching portion 21 and the locking portion 48 on the left side of the release lever C3 to each other, and, further, by abutting the front and rear lateral sides 21*a* of the attaching portion 21 and the front and rear lateral sides 33*a* of the fitting recess 33 to each other.

Figure 8:
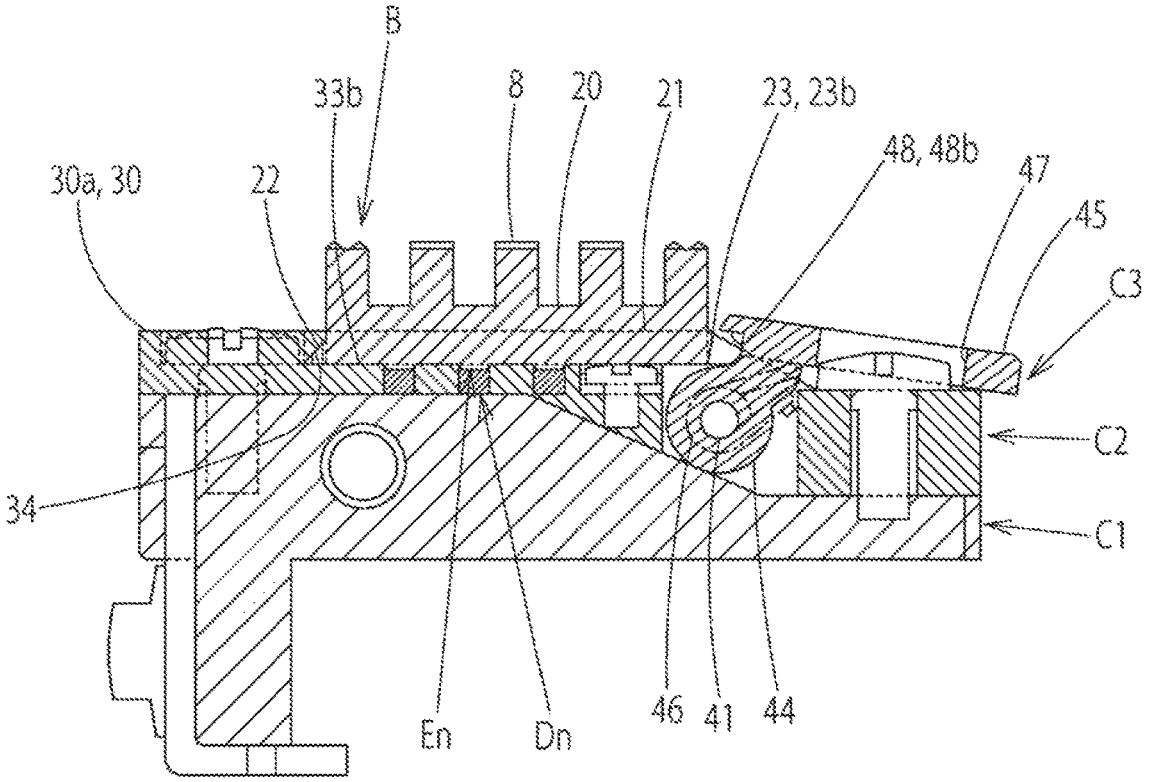
FIG. 8 is a cross-sectional view illustrating a manner in which a feed dog is dismounted from a feed bar in a sewing machine according to an exemplary embodiment of the present disclosure.

To detach the feed dog B from the feed bar C, as illustrated in FIG. 8, the finger hooked on the lever plate 45 of the release lever C3 is pushed down so that the release lever C3 pivots clockwise about the rotating shaft 41 and the locking portion 48 is lifted; accordingly, the lock between the lock underside 48*b* and the locking upper surface 23*b* of the locking protruding piece 23 of the attaching portion 21 is released. At the same time as the lock between the locking portion 48 and the locking protruding piece 23 is released, the attaching portion 21 is lifted from the right side with the upwards biasing force of the lifting spring 37 mounted in the fitting recess 33 and the engagement between the feed dog B and the fitting recess 33 is released. The feed dog B can be easily dismounted form the feed bar C.

Regarding the feed dog B and the feed bar C of the present exemplary embodiment, the feed dog B can be mounted on the feed dog mount portion C2 of the feed bar C easily, and the feed dog B can be dismounted easily by pressing down the release lever C3 of the feed bar C; accordingly, a feed dog B optimum for the material and thickness of the stitched fabric and for the type of the sewing can be mounted on the feed dog mount portion C2 by having a plurality of types of feed dog B, including feed dog portions 20 having tooth rows 8 with different heights and arrangement patterns, be readily available.

Figure 10:
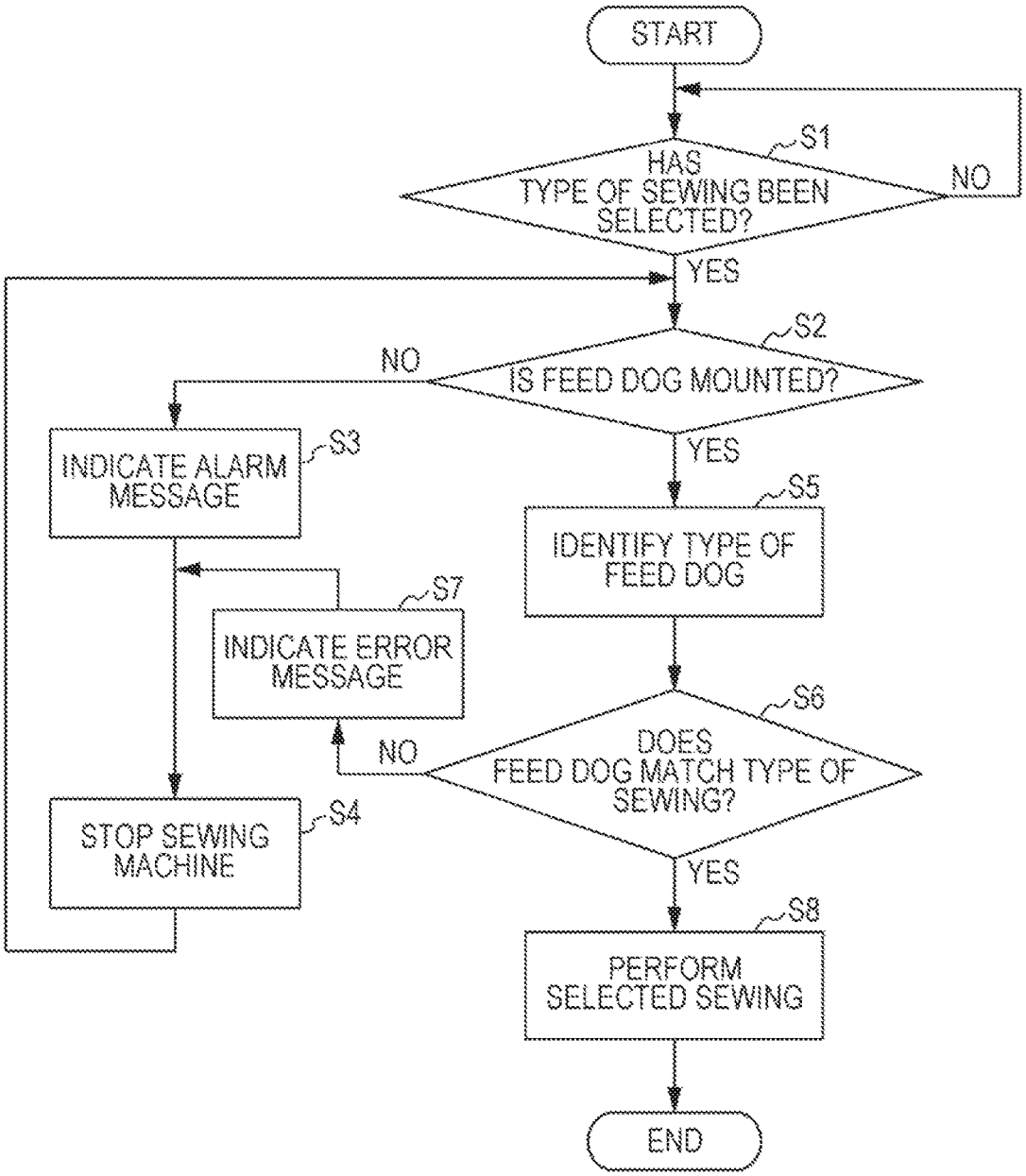
FIG. 10 is a flow chart illustrating a method in which a type of an installed feed dog is identified after mounting and dismounting of the feed dog have been detected in a control unit of a sewing machine according to an exemplary embodiment of the present disclosure.
Figure 11:
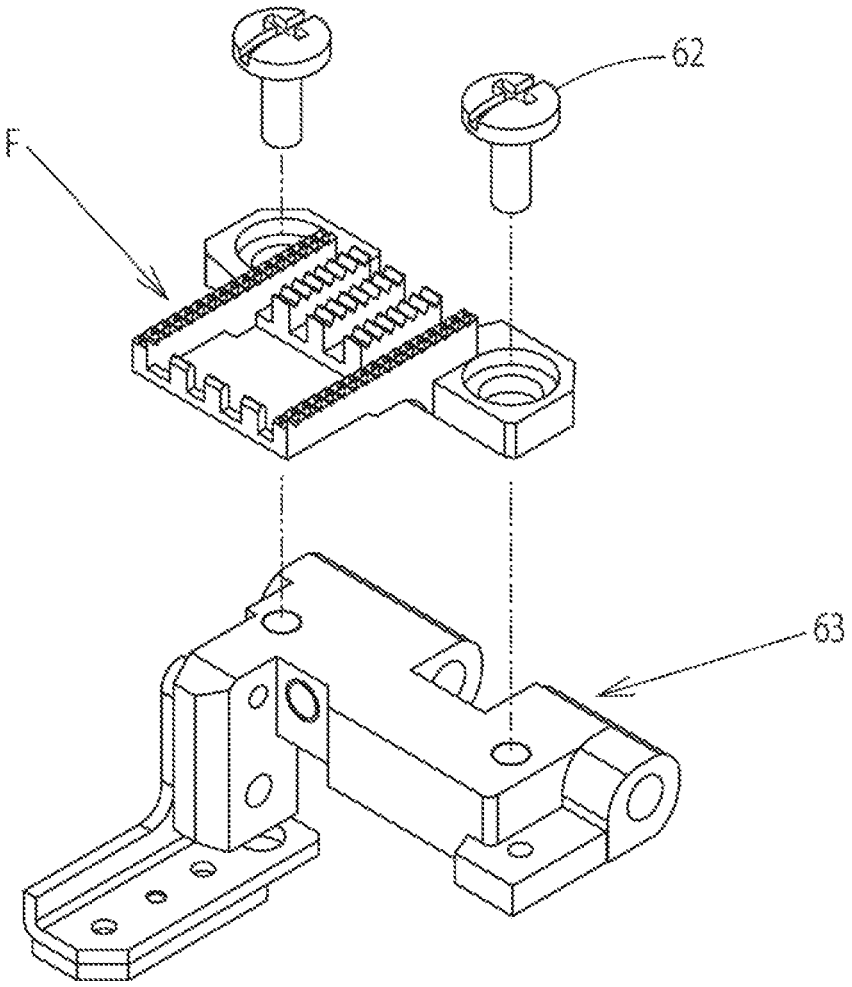
FIG. 11 is a perspective view illustrating a conventional technique in which a feed dog is fixed on a feed bar.

In the feed dog mount portion C2, the three pressure sensors D1, D2, and D3 are provided on the bottom surface 33*b* of the fitting recess 33, and in the feed dog B, one to three projections E that function as a pressing portion opposing the pressure sensors D are provided on the underside 21*b* of the attaching portion 21 so that, as in the flow chart illustrated in FIG. 10 described later, the pressure sensors D detect the mounting and dismounting of the feed dog B by detecting the pressing force of the projections E, and an identification signal is sent to the control unit 54 illustrated in FIG. 9; accordingly, in a case in which the feed dog B is not mounted on the feed dog mount portion C2, the sewing machine can be configured to not start operating even when the start/stop switch 53 is operated.

In the present exemplary embodiment, the sensor group Dn includes three pressure sensors D1, D2, and D3 on the bottom surface 33*b* of the fitting recess 33, and the projection row En provided on the underside 21*b* of the attaching portion 21 formed on the feed dog B includes one to three projections E that oppose the three pressure sensors D1, D2, and D3. Regarding the arrangement pattern of the one to three projections E constituting the projection row En, assuming that "1" denotes a case in which there is a projection E and "0" denotes a case in which there is no projection E, when the identification code expressing the existence of a projection E is expressed in the order of projections E3, E2, and E1, there will be seven identification codes, namely, "001", "010", "011", "100", "101", "110", and "111".

As in the present exemplary embodiment, in a case in which the sensor group Dn is provided with three pressure sensors D1, D2, and D3, projection rows En that have seven arrangement patterns can be identified; accordingly, at the most, seven feed dogs B that each have tooth rows 8 in which the tooth height and the arrangement pattern have been changed, can be identified. Note that in the present exemplary embodiment, while the number of pressure sensors D provided on the bottom surface 33*b* of the fitting recess 33 is three, the number of pressure sensors D can be n, and the maximum number of projections E can be n as well so as to match the number of pressure sensors D. In such a case, the number of arrangement patterns of the projection E is, at the most, (n-th power of 2)-1.

Furthermore, other than the projection row En for identifying the mounted feed dog B, a projection (not shown) serving as a pressing portion dedicated for detection of whether the feed dog B is mounted or dismounted can be provided, and a pressure sensor (not shown) dedicated for detection of whether the feed dog B is mounted or dismounted can be provided on the feed dog mount portion C2. In such a case, "000" can be used as the identification code of the arrangement pattern of the projection E of the feed dog B.

A manner in which the control unit 54 identifies the type of the mounted feed dog B when an operator mounts the feed dog B on the feed dog mount portion C2 as illustrated in the block diagram in FIG. 9 will be described next with the flow chart in FIG. 10.

First, since the operator views the "type of the sewing selection" display in the work menu displayed on the liquid crystal display 60 and waits for the type of the sewing to be selected on the transparent touch panel 52 stacked on the front side of the liquid crystal display 60, in determining "Has the type of the sewing been selected?" in step S1, "NO" is determined until the type of the sewing is selected, and the determination loop of step S1 is repeated until the type of the sewing is selected. Subsequently, in step S1, when the operator touches the touch panel 52 and the type of the sewing is selected, "YES" is determined, and the process proceeds to step S2.

Subsequently, in step S2, determination on "Is feed dog mounted?" is made. In the example in FIG. 9, since the feed dog B is not mounted on the feed dog mount portion C2, the identification code input to the control unit 54 from the pressure sensors D1 to D3 of the feed dog mount portion C2 with the identification code transmitter 50 and the identification code receiver 51 is "000", "NO" is determined, and the process proceeds to step S3.

Subsequently, receiving the determination result of step S2, in step S3, an alarm message "Please attach the feed dog" is indicated through the liquid crystal display 60 to notify the operator that the feed dog B is not mounted on the feed dog mount portion C2, and the process proceeds to step S4. Note that the indication of the alarm message is not limited to a display of characters on the liquid crystal display 60 and may be performed through a phonetic representation. Subsequently, in step S4, a sewing machine stop command is issued to the sewing machine motor controller 61 and the start/stop switch 53 is made inoperable so that the sewing machine motor is not actuated even when the operator operates the start/stop switch 53. The process is returned to step S2, and the determination loop including steps S2 to S4 is repeated until the feed dog B is mounted on the feed dog mount portion C2.

Subsequently, when the operator mounts the feed dog B on the feed dog mount portion C2, since in the example in FIG. 9, the projection E provided on the feed dog B is E1 alone, and since the identification code input to the control unit 54 from the pressure sensors D1 to D3 of the feed dog mount portion C2 changes from "000" to "001", "YES" is determined in step S2, and the process proceeds to step S5.

Subsequently, after the identification code from the identification code transmitter 50 is received with the identification code receiver 51 and the identification code "001" is input to the control unit 54, in step S5, the type of the mounted feed dog B (the mounted feed dog B for straight stitching, for example) is identified from the input identification code, and the process proceeds to step S6. Subsequently, in step S6, when determination on "Does the feed dog match the type of sewing?" is made, in a case in which, for example, the type of the feed dog B identified in step S5 had been the feed dog for straight stitching and the type of the sewing identified in step S1 had been a feed dog B for zigzag stitching, since the feed dog B does not match the type of sewing, "NO" is determined, and the process proceeds to step S7.

Subsequently, receiving the determination result in step S6, in step S7, an error message "Please change the feed dog to the feed dog B for zigzag stitching" is indicated on the liquid crystal display 60 to inform the operator that the mounted feed dog B does not match the selected type of stitching, and the process proceed to step S4. Note that the indication of the error message is not limited to a display of characters on the liquid crystal display 60 and may be performed through a phonetic representation. Subsequently, in step S4, the sewing machine stop command is issued to the sewing machine motor controller 61 and the start/stop switch 53 is made inoperable so that the sewing machine motor is not actuated even when the operator operates the start/stop switch 53. The process is returned to step S2, and the process including steps S2 to S6 is repeated until the feed dog B matches the type of sewing.

Subsequently, when the operator changes the feed dog B to the feed dog B for zigzag stitching, since the feed dog B matches the type of sewing, "YES" is determined in step S6, and the process proceeds to step S8. Finally, in step S8, when the operator operates the start/stop switch 53, the control unit 54 commands the sewing machine motor controller 61 to start the sewing machine motor, and the sewing machine performs the selected type of sewing. As it can be understood from the above description, in the flow chart in FIG. 10, step S2 constitutes a feed dog mounted or dismounted determination means that determines whether the feed dog B is mounted or dismounted, step S4 constitutes a sewing machine stop commanding means, step S5 constitutes a feed dog identifying means that identifies the type of the feed dog B, step S6 constitutes a feed dog match determining means that determines whether the type of the feed dog B that has been identified matches the type of sewing, and step S7 constitutes an error indicating means.

As described above, by allowing the control unit 54 of the sewing machine to identify the type of the feed dog B mounted on the feed dog mount portion C2, sewing can be performed with the feed dog B that matches the selected type of the sewing mounted on the feed bar C. Furthermore, after identifying the feed dog B mounted on the feed bar C, the type of the sewing that matches the identified feed dog B may be displayed on the liquid crystal display 60.

In the present exemplary embodiment, while the feed dog B accommodated inside the free arm portion 2 of the bed portion 1 is changeable in a detachable manner; it goes without saying that the present disclosure is not limited to a sewing machine that includes a free arm portion such as the one described above and may be applied to sewing machines including various forms of bed portions.

The sewing machine of the present disclosure is capable of having the operator change the feed dog in a detachable manner with a simple operation, and is capable of automatically determining whether the feed dog matches the type of the sewing and whether the feed dog has been reliably mounted on the feed bar by automatically identifying the feed dog that has been mounted with the replacement work; accordingly, sewing can be performed after selecting the feed dog that matches the selected type of sewing, and the sewing machine can be widely applied to various sewing machines advantageously.

What is claimed is:

1. A sewing machine capable of replacing a feed dog in accordance with a type of sewing, the sewing machine comprising:

a feed bar performing a horizontal motion and a vertical motion by interlocking with a feeding mechanism;

a feed dog detachably mounted on the feed bar; and a control unit that identifies the feed dog mounted on the feed bar, wherein the feed dog includes an identification member that corresponds to a type of the feed dog, wherein the feed bar includes a sensor member that detects the identification member and outputs an identification signal, and wherein the control unit includes a feed dog identifying means that, based on the identification signal from the sensor member, identifies the type of the feed dog mounted on the feed bar.

2. The sewing machine according to claim 1, wherein the identification member includes a pressing portion formed on the feed dog, wherein the sensor member includes a pressure sensor that detects pressing force of the pressing portion and that outputs a pressure-sensitive signal, and wherein the control unit includes a feed dog mounted or dismounted determination means that, based on whether there is the pressure-sensitive signal from the pressure sensor, determines whether the feed dog is mounted or dismounted.

3. The sewing machine according to claim 2, further comprising:

a sewing machine motor controller that controls the sewing machine motor and that starts or stops the sewing machine, wherein the control unit includes a sewing machine stop commanding means that commands stoppage of the sewing machine to the sewing machine motor controller in a case in which the feed dog mounted or dismounted determination means determines that the feed dog is not mounted.

4. The sewing machine according to claim 2, wherein the pressing portion includes a projection that projects from an underside of the feed dog, and wherein the feed bar includes, at a position opposing the projection, an attachment hole in which the pressure sensor is embedded.

5. The sewing machine according to claim 1,
wherein the identification member includes a projection row in which at least one projection is arranged, and
wherein the sensor member includes a pressure sensor group that opposes the projection row, the pressure sensor group detecting whether there is the projection and outputting an identification signal corresponding to the projection row.

6. The sewing machine according to claim 5,
wherein the control unit includes a feed dog mounted or dismounted determination means that, based on the identification signal from the pressure sensor group, determines whether the feed dog is mounted or dismounted.

7. The sewing machine according to claim 6, further comprising:
a sewing machine motor controller that controls the sewing machine motor and that starts or stops the sewing machine,
wherein the control unit includes a sewing machine stop commanding means that commands stoppage of the sewing machine to the sewing machine motor controller in a case in which the feed dog mounted or dismounted determination means determines that the feed dog is not mounted.

8. The sewing machine according to claim 1,
wherein the feed bar incudes
a feed bar base portion that is interlocked with the feeding mechanism, and
a feed dog mount portion that is attached so as to be capable of being positioned with respect to the feed bar base portion, the sensor member being provided in the feed dog mount portion, and
wherein the feed dog includes an attaching portion that is detachably mounted on the feed dog mount portion, the identification member being provided in the attaching portion.

9. The sewing machine according to claim 8,
wherein the identification member includes a pressing portion formed on the attaching portion,
wherein the sensor member includes a pressure sensor that detects pressing force of the pressing portion and that outputs a pressure-sensitive signal, and
wherein the control unit includes a feed dog mounted or dismounted determination means that, based on whether there is the pressure-sensitive signal from the pressure sensor, determines whether the feed dog is mounted or dismounted.

10. The sewing machine according to claim 9,
wherein the pressing portion includes a projection that projects from an underside of the attaching portion, and
wherein the feed dog mount portion includes, at a position opposing the projection, an attachment hole in which the pressure sensor is embedded.

11. The sewing machine according to claim 8,
wherein the identification member includes a projection row in which at least one projection is arranged, and
wherein the sensor member includes a pressure sensor group that opposes the projection row, the pressure sensor group detecting whether there is the projection and outputting an identification signal corresponding to the projection row.

12. The sewing machine according to claim 8,
wherein the feed dog mount portion includes
a lifting spring that biases the attaching portion upwards, and
a release lever countering biasing force of the lifting spring that presses and fixes the attaching portion to the feed dog mount portion.

13. The sewing machine according to claim 12,
wherein the identification member includes a pressing portion formed on the attaching portion,
wherein the sensor member includes a pressure sensor that detects pressing force of the pressing portion and that outputs a pressure-sensitive signal, and
wherein the control unit includes a feed dog mounted or dismounted determination means that, based on whether there is the pressure-sensitive signal from the pressure sensor, determines whether the feed dog is mounted or dismounted.

14. The sewing machine according to claim 13,
wherein the pressing portion includes a projection that projects from an underside of the attaching portion, and
wherein the feed mount unit includes, at a position opposing the projection, an attachment hole in which the pressure sensor is embedded.

15. The sewing machine according to claim 12,
wherein the identification member includes a projection row in which at least one projection is arranged, and
wherein the sensor member includes a pressure sensor group that opposes the projection row, the pressure sensor group detecting whether there is the projection and outputting an identification signal corresponding to the projection row.

16. The sewing machine according to claim 1,
wherein the control unit includes a feed dog match determining means that determines whether the type of the feed dog identified by the feed dog identifying member matches the type of the sewing that has been selected.

17. The sewing machine according to claim 16,
wherein the identification member includes a pressing portion formed on the feed dog,
wherein the sensor member includes a pressure sensor that detects pressing force of the pressing portion and that outputs a pressure-sensitive signal, and
wherein the control unit includes a feed dog mounted or dismounted determination means that, based on whether there is the pressure-sensitive signal from the pressure sensor, determines whether the feed dog is mounted or dismounted.

18. The sewing machine according to claim 17, further comprising:
a sewing machine motor controller that controls the sewing machine motor and that starts or stops the sewing machine,
wherein the control unit includes a sewing machine stop commanding means that commands stoppage of the sewing machine to the sewing machine motor controller in a case in which the feed dog mounted or dismounted determination means determines that the feed dog is not mounted.

19. The sewing machine according to claim 16,
wherein the control unit includes an error indicating means that informs an operator that an error has occurred in a case in which the feed dog match determining means determines that the type of the feed dog mounted on the feed bar does not match the type of the sewing that has been selected.

20. The sewing machine according to claim 19,
wherein the identification member includes a pressing portion formed on the feed dog, wherein the sensor member includes a pressure sensor that detects pressing force of the pressing portion and that outputs a pressure-sensitive signal, and wherein the control unit includes a feed dog mounted or dismounted determination means that, based on whether there is the pressure-sensitive signal from the pressure sensor, determines whether the feed dog is mounted or dismounted.

21. The sewing machine according to claim 20, further comprising:

a sewing machine motor controller that controls the sewing machine motor and that starts or stops the sewing machine, wherein the control unit includes a sewing machine stop commanding means that commands stoppage of the sewing machine to the sewing machine motor controller in a case in which the feed dog mounted or dismounted determination means determines that the feed dog is not mounted.

22. The sewing machine according to claim 19, wherein the identification member includes a projection row in which at least one projection is arranged, and wherein the sensor member includes a pressure sensor group that opposes the projection row, the pressure sensor group detecting whether there is the projection and outputting an identification signal corresponding to the projection row.

23. The sewing machine according to claim 22, wherein the control unit includes a feed dog mounted or dismounted determination means that, based on the identification signal from the pressure sensor group, determines whether the feed dog is mounted or dismounted.

24. The sewing machine according to claim 23, further comprising:

a sewing machine motor controller that controls the sewing machine motor and that starts or stops the sewing machine, wherein the control unit includes a sewing machine stop commanding means that commands stoppage of the sewing machine to the sewing machine motor controller in a case in which the feed dog mounted or dismounted determination means determines that the feed dog is not mounted.

25. The sewing machine according to claim 16, wherein the identification member includes a projection row in which at least one projection is arranged, and wherein the sensor member includes a pressure sensor group that opposes the projection row, the pressure sensor group detecting whether there is the projection and outputting an identification signal corresponding to the projection row.

26. The sewing machine according to claim 25, wherein the control unit includes a feed dog mounted or dismounted determination means that, based on the identification signal from the pressure sensor group, determines whether the feed dog is mounted or dismounted.

27. The sewing machine according to claim 26, further comprising:

a sewing machine motor controller that controls the sewing machine motor and that starts or stops the sewing machine, wherein the control unit includes a sewing machine stop commanding means that commands stoppage of the sewing machine to the sewing machine motor controller in a case in which the feed dog mounted or dismounted determination means determines that the feed dog is not mounted.

* * * * *